US009979091B2

(12) United States Patent
Van Zeijl et al.

(10) Patent No.: US 9,979,091 B2
(45) Date of Patent: May 22, 2018

(54) HORN-LIKE EXTENSION FOR INTEGRATED ANTENNA

(71) Applicant: OMNIRADAR BV, Maarssen (NL)

(72) Inventors: Paulus Thomas Maria Van Zeijl, Veldhoven (NL); Hans Brouwer, Maarssen (NL); Jaques Leopold Catharina Rompen, Eindhoven (NL); Timofey Grigorievich Savelyev, Eindhoven (NL)

(73) Assignee: OMNIRADAR BV, Maarssen (NL)

( * ) Notice: Subject to any disclaimer, the term of this patent is extended or adjusted under 35 U.S.C. 154(b) by 140 days.

(21) Appl. No.: 14/785,822

(22) PCT Filed: Apr. 28, 2014

(86) PCT No.: PCT/NL2014/050276
§ 371 (c)(1),
(2) Date: Oct. 20, 2015

(87) PCT Pub. No.: WO2014/175741
PCT Pub. Date: Oct. 30, 2014

(65) Prior Publication Data

US 2016/0079675 A1 Mar. 17, 2016

(30) Foreign Application Priority Data

Apr. 26, 2013 (NL) ..... 1040185

(51) Int. Cl.
*H01Q 13/02* (2006.01)
*H01Q 21/06* (2006.01)
(Continued)

(52) U.S. Cl.
CPC ..... *H01Q 13/02* (2013.01); *H01Q 1/2283* (2013.01); *H01Q 13/065* (2013.01); *H01Q 19/08* (2013.01);
(Continued)

(58) Field of Classification Search
CPC .... H01Q 13/02; H01Q 13/065; H01Q 1/2283; H01Q 21/0093; H01Q 21/064; H01Q 23/00
See application file for complete search history.

(56) References Cited

U.S. PATENT DOCUMENTS

2003/0151560 A1* 8/2003 Kienzle ..... G01F 23/284 343/786
2009/0066590 A1* 3/2009 Yamada ..... H01Q 13/02 343/702
2009/0066598 A1* 3/2009 Malstrom ..... H01Q 13/02 343/786

FOREIGN PATENT DOCUMENTS

EP 1357395 A1 10/2003
JP H11340724 A 12/1999
(Continued)

OTHER PUBLICATIONS

International Search Report dated Jun. 25, 2014, for International Patent Application No. PCT/US2014/050276.
(Continued)

*Primary Examiner* — Robert Karacsony
(74) *Attorney, Agent, or Firm* — Karceski IP Law, PLLC

(57) ABSTRACT

A radiofrequency assembly includes a module with an antenna assembly formed in a semiconductor integrated circuit. The semiconductor integrated circuit can carry out at least one of the following functions: transmitting an electromagnetic signal, and receiving an electromagnetic signal. The radiofrequency assembly further includes a horn-like structure with a base portion adapted to fit on the module. The horn-like structure has an extending horn-shaped portion an input opening that encloses the antenna assembly when the horn-like structure is fitted on the module.

13 Claims, 6 Drawing Sheets

(51) Int. Cl.

| | |
|---|---|
| ***H01Q 21/00*** | (2006.01) |
| ***H01Q 19/08*** | (2006.01) |
| ***H01Q 1/22*** | (2006.01) |
| ***H01Q 13/06*** | (2006.01) |
| ***H01Q 23/00*** | (2006.01) |

(52) U.S. Cl.
CPC ..... *H01Q 21/0093* (2013.01); *H01Q 21/064* (2013.01); *H01Q 23/00* (2013.01)

(56) References Cited

FOREIGN PATENT DOCUMENTS

| | | | |
|---|---|---|---|
| JP | 2007286843 | A | 11/2007 |
| WO | WO 03078936 | A1 | 9/2003 |
| WO | WO 2014049088 | A1 | 4/2014 |

OTHER PUBLICATIONS

Yu-Chin Ou et al: "On-Chip Slot-Ring and High-Gain Horn Antennas for Millimeter-Wave Wafer-Scale Silicon Systems," IEEE Transactions on.
Microwave Theory and Techniques, IIE Service Center, Piscataway, NY, US, vol. 59, No. 8, Aug. 1, 2011.

* cited by examiner

HORN-LIKE EXTENSION FOR INTEGRATED ANTENNA

CROSS-REFERENCE TO RELATED APPLICATIONS

This is a National Stage Entry into the United States Patent and Trademark Office from International PCT Patent Application No. PCT/NL2014/050276, having an international filing date of Apr. 28, 2014, and which relies for priority on Netherlands Patent Application No. 1040185, filed Apr. 26, 2013, the entire contents of both of which are incorporated herein by reference.

FIELD OF THE INVENTION

The invention relates to a module comprising an antenna assembly formed in a semiconductor integrated circuit. The module may functionally constitute, for example, a radar device.

BACKGROUND OF THE INVENTION

Analog and digital integrated circuits (ICs) are typically designed and manufactured in silicon, GaAs, GaN or SiGe processes, which may be of the BiCMOS or CMOS type. These ICs can be mass-produced, for example, on 8 or 12 inch wafers. After production of a wafer, the wafer is diced to separate the ICs from each other, typically through sawing.

Dicing process is a relatively rough process: a diamond saw cuts through a wafer. As silicon is quite brittle, cracks may form relatively easily and extend into electronic circuitry. The electronic circuitry may then become defective: it is not capable of operating according to desired specifications, or even not capable of operating at all.

A standard way of preventing cracks forming into the electronic circuitry is by placing a "seal-ring" around all circuitry. A seal-ring is a ring consisting of (nearly) all doping- and metal-layers placed around the electronic circuitry. Silicon-nitride is usually placed as last layer on top of all circuitry (except bump-pads and bond-pads as they need to be electrically connected to the outside world) to prevent moisture getting into the silicon. The seal-ring also has an opening in the silicon-nitride as a silicon-nitride layer is also quite brittle (similar to glass), again to prevent cracks from entering the IC.

This seal-ring is therefore an essential part of the mass-production process of silicon chips in order to realize a high reliability and a high yield.

With integration of RF electronics on silicon, proposals of implementing antennas on silicon have come up. Antennas are used in all electronic equipment (from GSM, GPS, DECT, Bluetooth to radar systems) to convert electrical energy to electromagnetic energy and vice-versa. However, when these antennas are placed inside a seal-ring, the seal-ring can short the electromagnetic field of the antenna. This reduces radiation efficiency and affects the radiation pattern of the antenna. Some antenna-on-silicon designs simply ignore production process requirements by leaving out the seal-ring, resulting in lower yields or reliability problems or breakdown after some time in the application. Other designs implement antennas in special post-production processes thus increasing overall costs.

Modern IC processes require a minimum and maximum use of metal per given silicon-area for reproducibility of the etching process and the chemical-mechanical-polishing used in the back-end processing. Usually a defined metal-filling (called tiling) using minimum sized structures fulfils the metal density requirement without disturbing overall performance too much.

When antennas are placed on the silicon, testing becomes an issue as DC-voltage, output power and matching can no longer be measured.

When the abovementioned problems are solved, antennas can be integrated side-to-side a complete radar. Even if the antenna is not integrated on the silicon but in the package the overall "module" can be seen as a single device. Antennas usually have a size close to lambda/4 or lambda/2, where lambda is the wavelength in the material or in free-space. For 60 GHz the free-space wavelength is 5 mm, and antenna can thus be 1.25 mm or smaller pending the dielectric constant of the material.

Single antennas usually have a relatively wide radiation pattern, which can be as wide as ±60 degrees in azimuth and ±60 degrees in elevation. For some applications this beam-width is too wide. Narrower beam-widths can be realized with antenna arrays: multiple antennas in a row, column or matrix driven with the proper phase and amplitude for each antenna. This can be done on the silicon, but results in a new design (usually resulting in a much larger silicon area to accommodate the extra antennas) and thus a new, expensive mask-set. Economy of scales may be difficult to reach if the market consists of a large number of applications with low quantities. It would be much nicer if a low-cost, easy to mass-produce, auto-aligned structure can be made that allows defining the radiation pattern after the silicon is produced.

Parabolic dish antennas and horn antennas have been known to provide well defined gains and (narrow) beam-widths. However, a special heavy and expensive launcher used to launch the electromagnetic wave into a waveguide or horn antenna. For satisfactory performance the waveguide should also be aligned with the horn antenna.

SUMMARY OF THE INVENTION

There is a need for a solution that allows achieving a desired radiation pattern with integrated antennas at relatively low cost and suitable for mass production.

In accordance with an aspect of the invention, there is provided a radiofrequency assembly that includes:

- a module comprising an antenna assembly formed in a semiconductor integrated circuit and arranged to carry out at least one of the following functions: transmitting an electromagnetic signal, and receiving an electromagnetic signal; and
- a horn-like structure including:
  - a base portion adapted to fit on the module;
  - an extending horn-shaped portion having an input opening that encloses the antenna assembly when the horn-like structure is fitted on the module.

The base portion may include an inner circumference that matches with an outer circumference of the module.

The base portion may include L-shaped edges that engage with edge portions of the module.

The antenna assembly that is enclosed by the input opening of the extending horn-shaped portion may include various antennas.

The antennas may be located off center with respect to the input opening.

The antenna assembly may include at least one transmitter antenna and at least one receiver antenna.

The antenna assembly may include various receiver antennas for an angle of arrival measurement.

In addition, solutions are provided to avoid a seal ring from significantly influencing an electro-magnetic-field, and solutions for testing a radiofrequency module with integrated antennas.

DETAILED DESCRIPTION

Figure 1:
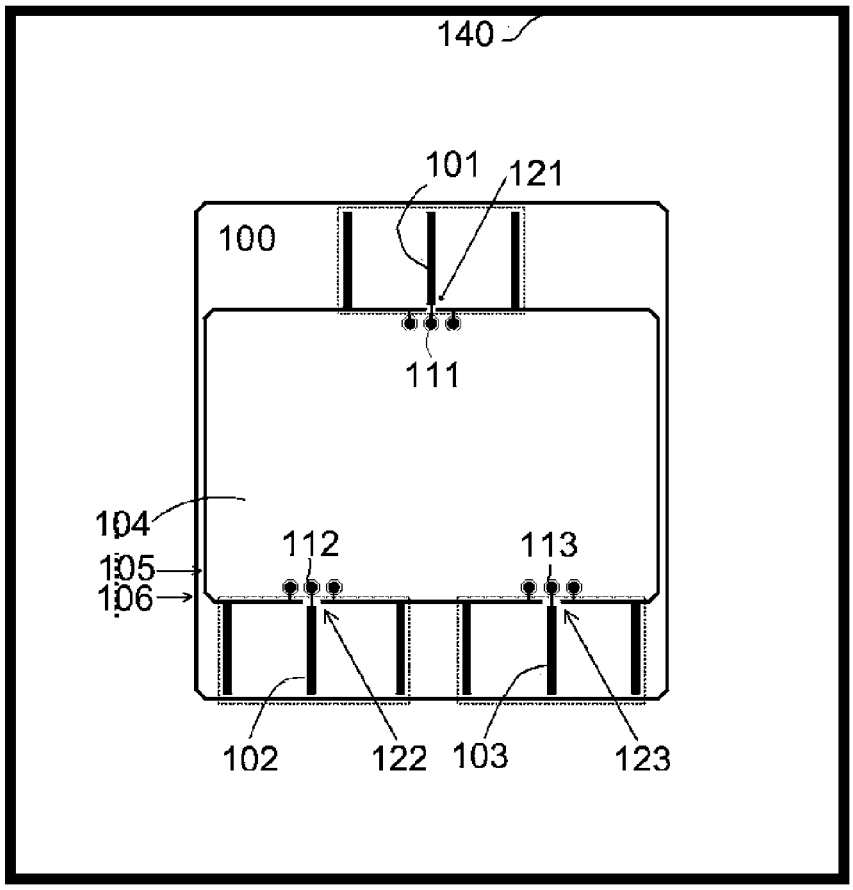
FIG. 1 is a schematic top view of an integrated circuit with integrated antennas.

FIG. 1 illustrates an example of an integrated circuit (IC) 100. FIG. 1 provides a schematic top view of the integrated circuit 100. The integrated circuit 100 comprises three antennas 101, 102, and 103. A first antenna 101 is located near one side of the integrated circuit 100. A second antenna 102 and a third antenna 103 are located near an opposite side of the integrated circuit 100. The integrated circuit 100 comprises electronic circuits 104, which may include analog circuits as well as digital circuits.

The integrated circuit 100 further comprises two seal rings: an inner seal ring 105 and an outer seal ring 106. These seal rings 105, 106 prevent cracks from occurring in the electronic circuits 104 in a dicing process as explained hereinbefore. The inner seal ring 105 may comprise all doping layers in combination with all metal layers. The outer seal ring 106 may also comprise all doping layers and all metal layers. In the example of FIG. 1, the inner seal ring 105 and the outer seal ring 106 are non-overlapping. In an alternative embodiment, such seal rings may partially overlap along at least one side of the integrated circuit 100.

The first antenna 101 is coupled to a center bond pad 111 that has two neighboring side bond pads: a left side bond pad and a right side bond pad. Similarly, the second antenna 102 is coupled to a center bond pad 112, which has two neighboring side bond pads: a left side bond pad and a right side bond pad. The third antenna 103 is coupled to a center bond pad 113, which has two neighboring side bond pads: a left side bond pad and a right side bond pad. The aforementioned neighboring side bond pads may be coupled to signal ground and the inner seal-ring 105. In some applications, it may be useful to avoid metal layers in an area around an antenna. FIG. 1 illustrates such areas around the three antennas 101, 102, and 103 by means rectangles in broken lines.

The inner seal ring 105 comprises an opening 121 near a base of the first antenna 101. The opening 121 extends to a top metal layer and a via layer that is associated with this top metal layer, which layers form part of the inner seal ring 105. A connection between the first antenna 101 and the center bond pad 111 passes through this opening 121 in the inner seal ring 105. The inner seal ring 105 comprises similar openings 122 and 123 near a base of the second antenna 102 end near a base of the third antenna 103, respectively.

The integrated circuit 100 illustrated in FIG. 1 may functionally form, for example, a radar device, such as, a Frequency Modulated Continuous Wave (FMCW) radar device. In FMCW radar devices, a transmitter and a receiver operate simultaneously. Isolation between the transmitter and the receiver, including antennas, is therefore important. If there is insufficient isolation, this will significantly impair radar performance, in particular in terms of detection range. In FIG. 1, the first antenna 101 may be, for example, a transmitter antenna. The second and third antennas 102, 103 may then be receiver antennas. In this configuration, the isolation between the transmitter antenna and the receiver antennas can be sufficient for satisfactory radar performance. The use of two receiver antennas, the second and third antennas 102, 103, allows determining an angle-of-arrival of reflections in a radar mode setup.

The integrated circuit 100 may be embedded in a module 140 as described in, for example, patent publication WO 2014/049088. This will be described in greater detail hereinafter.

Figure 2:
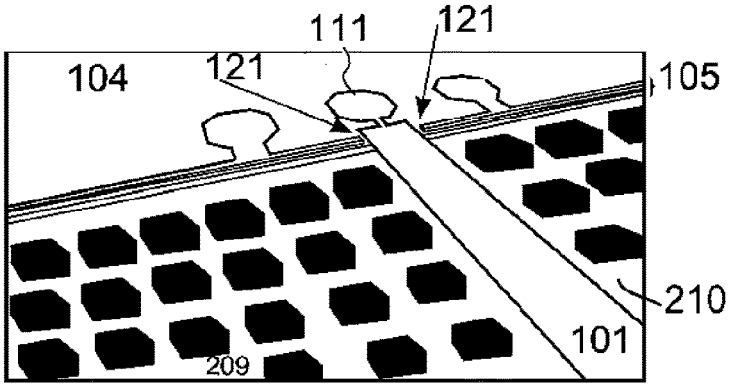
FIG. 2 is a perspective view of a portion of the integrated circuit near a base of an antenna.

FIG. 2 illustrates in greater detail a portion of the integrated circuit 100 near the base of the first antenna 101. FIG. 2 provides a perspective view of this integrated circuit portion. FIG. 2 clearly illustrates that the left side bond pad and the right side bond pad are coupled to the inner seal ring 105. FIG. 2 further clearly illustrates the opening 121 in the inner seal ring 105, which comprises an opening in the top metal layer that forms part of the inner seal ring. FIG. 2 further illustrates tiling areas 209 and 210 adjacent to the first antenna 101. These tiling areas 209 and 210 comprise patches formed in a metal layer that ensure a presence of metal in this layer within a desired use range.

Figure 3:
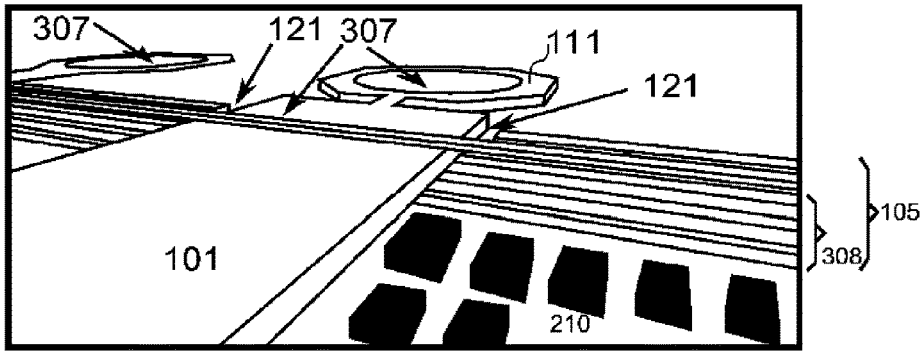
FIG. 3 is another perspective, semi-transparent view of this portion of the integrated circuit.

FIG. 3 illustrates another perspective, semi-transparent view of the portion concerned of the integrated circuit 100, in a direction from the outside towards the inside. The first antenna 101 is electrically coupled to the center bond pad 111 by means of a path formed in the top-metal layer. It should be noted that electrical coupling may be DC or AC. The opening 121 in the inner seal ring 105 is also clearly visible. FIG. 3 further illustrates openings 307 in a nitride layer that covers the integrated circuit 100. FIG. 3 further illustrates that the inner seal ring 105 comprises a pile-up of different layers 308, which lie underneath the path in the top metal layer, which electrically couples the first antenna 101 to the center bond pad 111. These layers 308 within the inner seal ring 105 are not affected by the opening 121 in this example.

Figure 4:
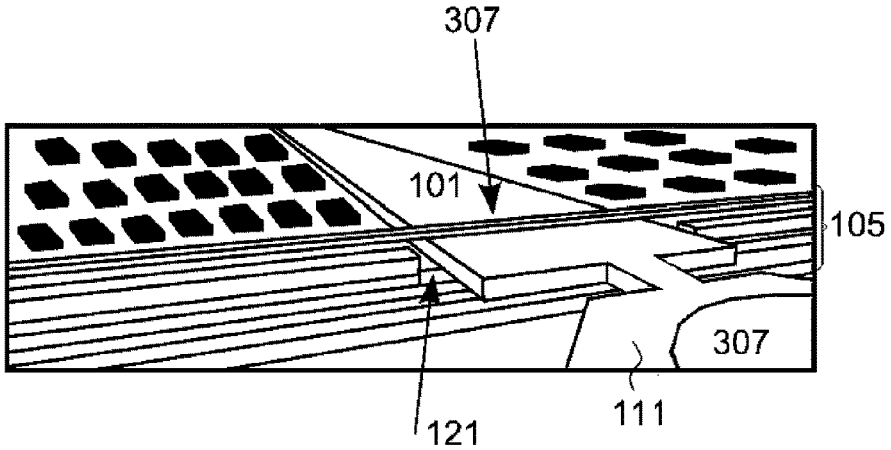
FIG. 4 is yet another perspective, semi-transparent view of this portion of the integrated circuit.

FIG. 4 shows yet another perspective, semi-transparent view of the portion concerned of the integrated circuit 100, in a direction from the inside towards the outside.

For testing purposes, several solutions can be envisaged. A first solution is to add bond pads or bump pads, or a combination of such pads, on which a signal of interest is present. Standard integrated circuit testing methods can be used to place probes on these pads. Accordingly, a DC levels can then be measured, as well as radiofrequency signal properties, such as, for example, frequency, amplitude, power, and spurious components. However, radiofrequency measurements may be influenced by antenna radiation. This influence can be accounted for by establishing reference measurement results and correlating actual measurement results with the reference measurements results. Accordingly, functionality and performance of a device-under-test can be determined.

A second solution can be to provide the integrated circuit 100 with on-chip measurements circuits. A DC voltage can be measured with an on-chip analog-to-digital converter. Preferably, a proper isolation circuit is provided so as to prevent that radiofrequency performance is adversely affected. The frequency of a radiofrequency signal can be measured indirectly by means of on-chip frequency dividers, which provide a frequency-divided signal whose frequency can be measured. An output power can be measured by means of an on-chip power sensor. Such a power sensor may have a large bandwidth. Any spurious component within the bandwidth of the power sensor will be measurable. Matching of an antenna to a circuit can be measured by an on-chip measurement of power reflected by the antenna.

An integrated antenna, such as the first, the second, or the third antenna 101, 102, 103, has a radiation pattern that is relatively wide, such as, for example, ±60 degrees. A narrower radiation pattern may be desired. In principle, this can be achieved by means of an array of integrated antennas. However, this is a relatively costly solution. An integrated antenna for electromagnetic signals in the millimeter wave range is relatively large. That is, a relatively large integrated circuit area is required to form an integrated antenna. In the example illustrated in FIG. 1, the three antennas 101, 102 and 103 already occupy an area that is similar in size as the area that the electronic circuitry 104 occupies.

A more cost-efficient solution for obtaining a relatively narrow radiation pattern is to place a horn like structure on an integrated circuit with integrated antennas, or on a module in which such an integrated circuit is embedded. The horn like structure preferably comprises a base portion that fits on the integrated circuit, or the module, whichever applies. The base portion may comprise an inner circumference that matches with an outer circumference of the integrated circuit, or the module, whichever applies. An extending horn-shaped portion of the horn like structure is disposed with respect to the base portion so that the extending horn-shaped portion is suitably disposed with respect to the integrated antennas or on the horn like structure is mounted on the integrated circuit, or the module, whichever applies.

Figure 5:
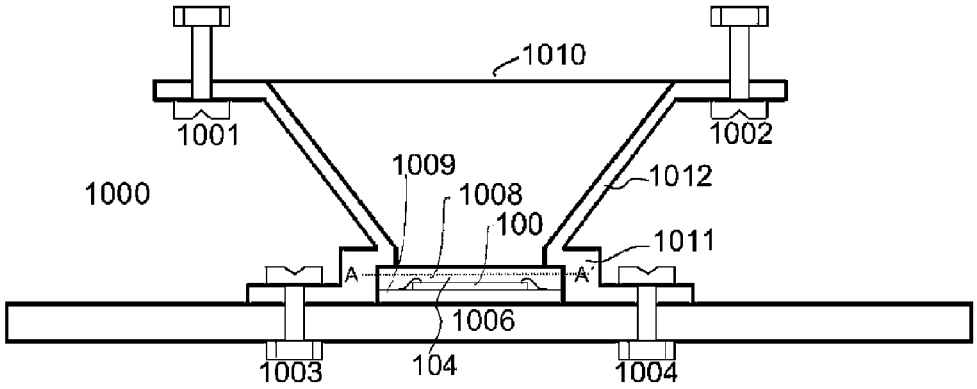
FIG. 5 is a schematic cross-sectional view of a radar assembly that comprises a horn-like structure, which is mounted on a module in which the integrated circuit is embedded.

FIG. 5 illustrates a radar assembly 1000 that comprises a horn-like structure 1010, which is mounted on the module 140 in which the integrated circuit 100 is embedded. FIG. 5 provides a schematic cross-sectional view of this assembly 1000. The module 140 comprises an epoxy layer 1008 that covers the integrated circuit 100. The module 140 further comprises a substrate 1009 on which the integrated circuit 100 is mounted by means of, for example, gluing. This substrate 1009 may be in the form of, for example, a printed circuit board. Bonding wires may electrically couple the integrated circuit 100 to the substrate 1009. The module 140 is mounted on a main printed circuit board 1006 by means of, for example soldering.

The horn-like structure 1010 comprises a base portion 1011 and an extending horn-shaped portion 1012. The base portion 1011 fits on the module 140. The base portion may comprise an inner circumference that matches with an outer circumference of the module. More specifically, the base portion 1011 may comprise L-shaped edges that engage with edge portions of the module 140 as illustrated in FIG. 5.

Dimensions of the module 140 may vary within a range of, for example, 50 μm. The base portion is designed to account for these tolerances so as to ensure a proper fit. The extending horn-shaped portion of the horn like structure is suitably disposed with respect to the base portion 1011 as will be discussed hereinafter. FIG. 5 thus illustrates a solution that allows automatic alignment and robustness, which are required for mass-production consumer-like products.

The horn-like structure 1010 may be mounted on the printed circuit board 1006 by means of, for example, screws 1003 and 1004. The radar assembly 1000 may be attached to a casing by means of screws 1001 and 1002 in a flange of an upper section of the extending horn-shape portion 1012. Instead of screws 1001-1004, clips or any other suitable fastening element can be used.

Figure 6:
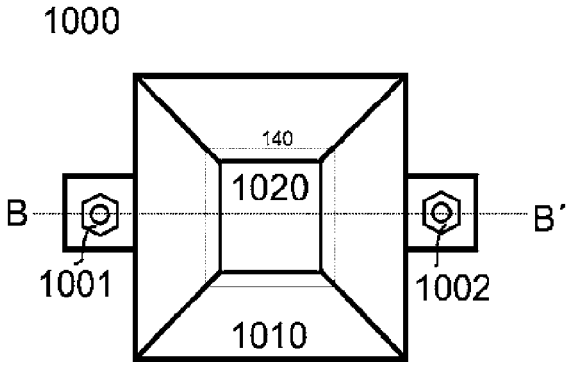
FIG. 6 is a schematic, top view of the radar assembly illustrated in FIG. 5.

FIG. 6 further illustrates the radar assembly 1000 by providing a schematic top view thereof. It is noted that the schematic cross-sectional view of FIG. 5 corresponds with a cross-section along line B-B' indicated in FIG. 6. The module 140 is represented by means of dotted lines. FIG. 6 illustrates that the extending horn-shaped portion 1012 has an input opening 1020, which faces the module 140. This input opening 1020 may be smaller than the module 140, but should preferably be larger than an area within which the three antennas 101, 102, and 103 are present. That is, the input opening should 1020 enclose the three antennas 101, 102, and 103.

Figure 7:
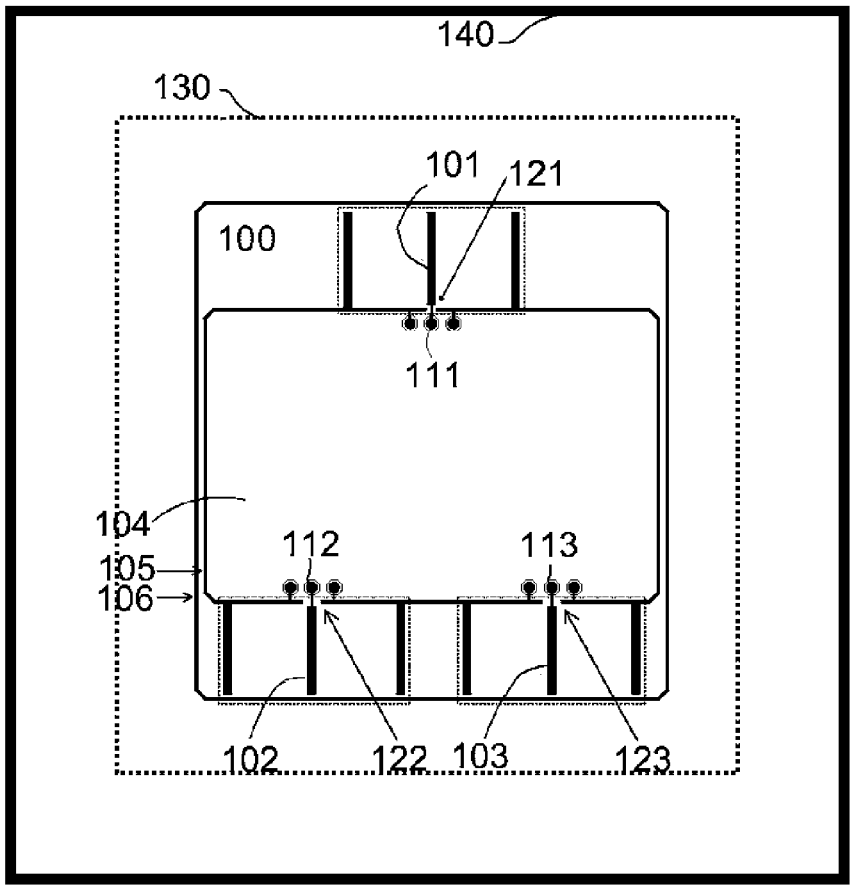
FIG. 7 is a completed version of FIG. 1 in which an input opening of the horn-like structure is indicated.

FIG. 7 is a completed version of FIG. 1 in which a rectangle 130 formed by dotted lines represents the input opening 1020 of the extending horn-shaped portion 1012 illustrated in FIG. 6. As an example, let it be assumed that the module 140 has a dimension of 7 by 7 mm. In this example, the input opening may be, for example, 5 by 5 mm. The outer seal ring 106 can be regarded as a circumference of the integrated circuit 100, which may be, for example, 3 by 3 mm.

In FIG. 6, it can be seen that the three antennas 101, 102, and 103 antennas are located somewhat off-centre, rather than exactly in the centre of the input opening of the extending horn-shaped portion. Surprisingly, this does not significantly affect performance. For example, an angle of arrival can be determined with sufficient precision by means of the second and third antennas 102, 103, which are the two receiver antennas. It has been found an off-centered integrated antenna can provide satisfactory performance in particular if the following general rule is observed. The integrated antenna has a distance with respect to a nearest boundary of the input opening that is at least $\lambda/2$, whereby $\lambda$ denotes a wavelength of interest, typically the wavelength at which the aforementioned radar device operates.

Figure 8:
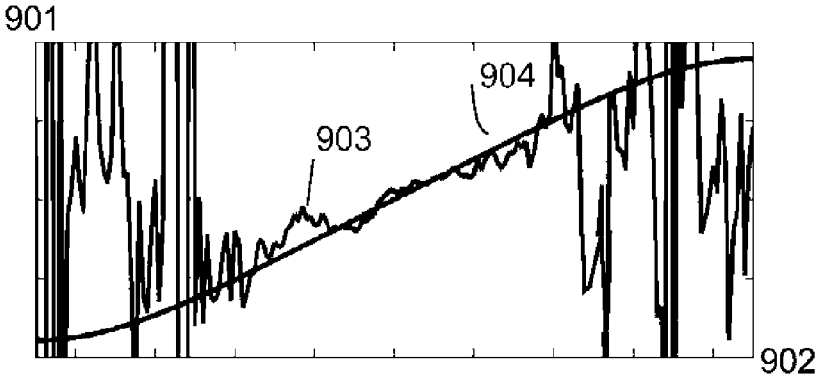
FIG. 8 is a diagram of angle-of-arrival measurements results that have been obtained.

FIG. 8 illustrates angle-of-arrival measurements results obtained with an integrated circuit, which has been provided with a horn-like structure. More specifically, FIG. 8 illustrates a mono-pulse radar characteristic obtained with a sum-and-difference method. In FIG. 8, a vertical axis 901 represents a difference pattern. A horizontal axis 902 represents an angle from which a reflection is received. Curve 903 represents a measured characteristic. Curve 904 shows a theoretical characteristic, which has been calculated based on theory. FIG. 8 thus shows that it is feasible to measure an angle of arrival with a radar assembly wherein multiple integrated antennas are within an opening end of a horn-like structure as illustrated in FIGS. 5 and 6.

An advantage of the solution described hereinbefore is that it is possible to obtain a wide variety of different radiations patterns on the basis of a same integrated circuit, as the one illustrated in FIG. 1. A desired radiation pattern can be obtained by placing on the integrated circuit a horn-like structure that has a particularly shaped and sized extending horn-shaped portion. The extending horn-shaped portion is shaped and sized so that a desired radiation pattern is obtained. According to theory on horn-antennas, a beam width, which can be characterized by a 3 dB reduction of maximum antenna gain, depends on an antenna aperture, which corresponds to a width of the extending horn-shaped portion. More specifically, the product of these parameters, antenna aperture and beam-width, is constant. This holds both for azimuth and for elevation.

Accordingly, a desired radiation pattern can be obtained by placing on the integrated circuit a horn-like extension having appropriate apertures. There is thus no need to design the integrated circuit for a specific radiation pattern. Moreover, it is relatively easy to modify a radiation pattern of a radar assembly as the one illustrated in FIGS. 5 and 6. It is sufficient to replace the hornlike extension by another horn-like extension. The solution described hereinbefore can thus be more cost efficient than entirely relying on an antenna array for obtaining a desired radiation pattern. In addition, the solution based on a horn-like structure obviates the need for a so-called launcher, which is typically used to convert signals from a cable connector assembly to a waveguide assembly. The horn-like structure can be regarded as functionally replacing such a launcher.

Figure 9A:
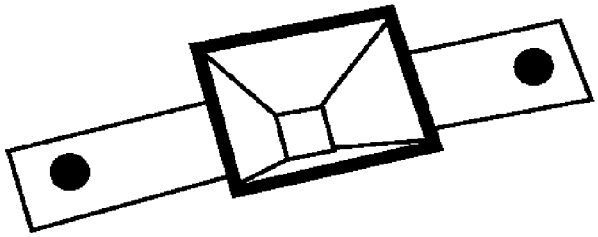
FIGS. 9*a*, 10*a*, 11*a* are schematic perspective views of several different horn-like structures.
Figure 9B:
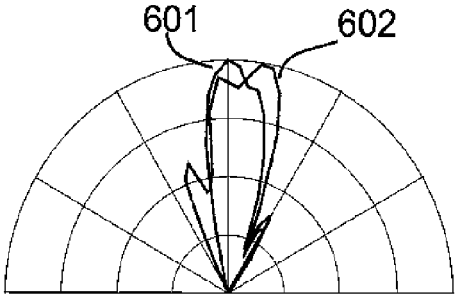
FIGS. 9*b*, 10*b*, 11*b* are diagrams of measured radiation patterns of the horn-like structures illustrated in FIGS. 9*a*, 10*a*, and 11*a*, respectively.
Figure 10A:
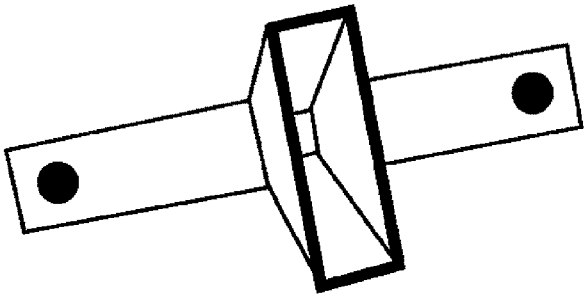
Figure 10B:
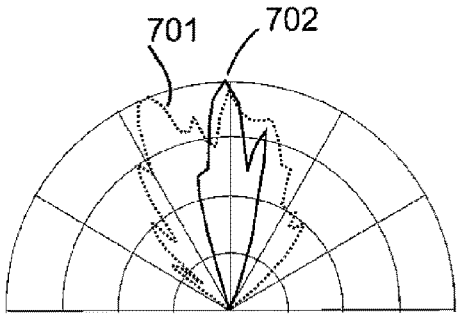
Figure 11A:
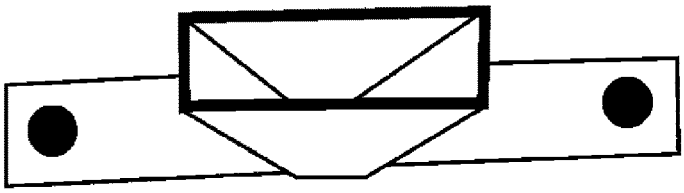
Figure 11B:
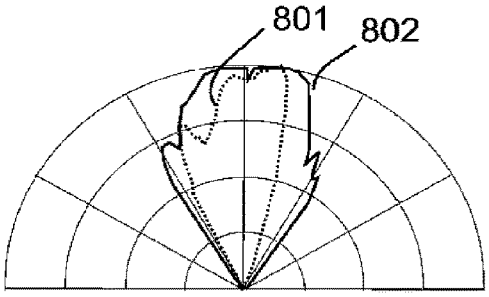

FIGS. 9*a*, 10*a*, and 11*a* illustrate several horn-like structures that can be placed on an integrated circuit with integrated antennas as the one illustrated in FIG. 1. FIGS. 9*b*, 10*b* and 11*b* illustrate measured radiation diagrams of the horn-like structures illustrated in FIGS. 9*a*, 10*a*, and 11*a*, respectively. In FIGS. 9*b*, 10*b* and 11*b*, curves 601, 701 and 801, respectively, represent a radiation pattern in azimuth direction. Curves 602, 702, 802, respectively, represent a radiation pattern in elevation direction. These figures clearly show that different radiation patterns can be obtained with different horn-like structures. These figures further confirm that the product of the aforementioned parameters, antenna aperture and beam-width, is constant.

Numerous different materials are suitable for making a horn-like structure like the one illustrated in FIGS. 5 and 6, as well as like those illustrated in FIGS. 9*a*, 10*a*, and 11*a*. For example, a horn-like structure may be made of standard copper-plated FR4 epoxy. Various other materials are also suitable: metal, plastic, in various combinations, plastic coated with metal, 3D-printed forms comprising metal, plastic or plastic coated with metal, plastic with a metal-tape or metal-spray, etc. Pure plastic may also be suitable if the plastic has an appropriate design and dielectric constant.

A horn-like structure may be open, that is, without any filling. However, a horn-like structure may be filled with a dielectric material. In fact, the horn-like structure may comprise a horn-shaped block of dielectric material. Surfaces of such a horn-shaped block may be provided with a metal coating by means of, for example, spraying. A dielectric filling material can be given a particular shape that forms a lens-like structure. This can contribute to obtaining a desired radiation pattern, such as, for example, a relatively narrow beam in a particular direction.

It should be noted that robustness depends on a combination of weight and size of, on the one hand, a horn-like structure and, on the other hand, a module comprising an integrated circuit. For example, the module illustrated in FIG. 5 may weigh less than 1 g. The horn-like structure may have a similar weight.

The detailed description hereinbefore with reference to the drawings is merely an illustration of the invention and the additional features, which are defined in the claims. The invention can be implemented in numerous different ways. In order to illustrate this, some alternatives are briefly indicated.

The invention may be applied in numerous types of products or methods related to transmitting or receiving electromagnetic signals, or both. Radar applications are merely an example. As another example, the invention may be applied to in telecommunication devices, which may comprise antennas formed an integrated circuit.

A horn-like structure need not necessarily have a rectangular shape as in the examples presented hereinbefore. For example, a horn-like structure may have a round shape, an elliptical shape, a hexagonal shape, or an octagonal shape, or any other type of angular shape.

A horn-like structure need not necessarily enclose three integrated antennas as in the examples presented during before. In principle, a horn-like structure may enclose any number of integrated antennas. A horn-like structure may enclose an array of antennas. Beam-steering is also possible with an array of antennas enclosed in a horn-like structure.

The solutions presented in this application are valid for different types of polarizations: horizontal, vertical, circular or any combination of these polarizations. Inserts in a back portion of a horn-like structure can be used to modify a polarization.

A horn-like structure can be manufactured in numerous different fashions, such as, for example, using standard plastic molding, 3D-printing, or even by hand.

The remarks made hereinbefore demonstrate that the detailed description with reference to the drawings is an illustration of the invention rather than a limitation. The invention can be implemented in numerous alternative ways that are within the scope of the appended claims. All changes that come within the meaning and range of equivalency of the claims are to be embraced within their scope. Any reference sign in a claim should not be construed as limiting the claim. The word "comprising" does not exclude the presence of other elements or steps than those listed in a claim. The word "a" or "an" preceding an element or step does not exclude the presence of a plurality of such elements or steps. The mere fact that respective dependent claims define respective additional features, does not exclude combinations of additional features other than those reflected in the claims.

The invention claimed is:

1. A radiofrequency assembly, comprising:

a module comprising an antenna assembly formed in a semiconductor integrated circuit and arranged to carry out at least one of the following functions: transmitting an electromagnetic signal, and receiving an electromagnetic signal;

a printed circuit board having a side on which the module is mounted; and a horn-like structure comprising:

a base portion adapted to fit on the module and extending to the side of the printed circuit board on which the module is mounted with fastening elements for mounting the horn-like structure on said side of the printed circuit board; and an extending horn-shaped portion having an input opening that encloses the antenna assembly when the horn-like structure is fitted on the module and mounted on the printed circuit board.

2. A radiofrequency assembly according to claim 1, wherein the base portion comprises an inner circumference that matches with an outer circumference of the module.

3. A radiofrequency assembly according to claim 2, wherein the base portion comprises L-shaped edges that engage with edge portions of the module.

4. A radiofrequency assembly according to claim 1, wherein the antenna assembly that is enclosed by the input opening of the extending horn-shaped portion comprises multiple antennas.

5. A radiofrequency assembly according to claim 4, wherein the antennas are located off center with respect to the input opening.

6. A radiofrequency assembly according to claim 4, wherein the antenna assembly comprises at least one transmitter antenna and at least one receiver antenna.

7. A radiofrequency assembly according to claim 4, wherein the antenna assembly comprises multiple receiver antennas for an angle of arrival measurement.

8. A radiofrequency assembly according to claim 1, wherein the horn-like structure is made of metal.

9. A radiofrequency assembly according to claim 1, wherein the horn-like structure is made of plastic and is covered with metal.

10. A radiofrequency assembly according to claim 1, wherein the horn-like structure comprises at least one of the following elements: flanges, reinforcing ribs, and mounting holes.

11. A radiofrequency assembly according to claim 1, wherein the horn-like structure is filled with a dielectric material and has a lens-like shape.

12. A radiofrequency assembly according to claim 1, comprising:

a printed circuit board;

a matrix of semiconductor integrated circuits mounted on the printed circuit board, and a matrix of horn-like structures being affixed on top of the semiconductor integrated circuits.

13. A radar system comprising a radiofrequency assembly according to claim 1.

* * * * *